US006373438B1

(12) United States Patent
Hwang

(10) Patent No.: US 6,373,438 B1
(45) Date of Patent: Apr. 16, 2002

(54) ANTENNA ASSEMBLY WITH IMPROVED MECHANICAL ANTENNA CASING

(75) Inventor: Jenq-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/836,999

(22) Filed: Apr. 17, 2001

(51) Int. Cl.[7] ..... H01Q 1/24
(52) U.S. Cl. ..... 343/702; 455/90
(58) Field of Search ..... 343/702, 895, 343/793, 700 MS, 872; 455/90

(56) References Cited

U.S. PATENT DOCUMENTS 5,555,459 A * 9/1996 Kraus et al. ..... 343/702
5,708,445 A * 1/1998 Moller et al. ..... 343/702

* cited by examiner

*Primary Examiner*—Don Wong
*Assistant Examiner*—Hoang Nguyen
(74) *Attorney, Agent, or Firm*—Wei Te Chung

(57) ABSTRACT

An antenna assembly has an antenna casing (1), a conductive antenna body (20), a metal reflector (22) and a coaxial cable (21). The antenna body includes a first and second arms (121), (122) and a U-shaped portion (123) connecting the first and second arms. The antenna casing includes a front wall (10), a back wall (11), a front compartment (18) between the cross wall and the front wall for receiving the antenna, a back compartment (17) between the cross wall and the back wall for receiving the associated reflector, a pair of supporting walls (103, 104) each defining an inclined notch (105) in which the antenna body is fixedly retained, and a cross wall (12) parallel to the back wall.

19 Claims, 5 Drawing Sheets

ANTENNA ASSEMBLY WITH IMPROVED MECHANICAL ANTENNA CASING

FIELD OF THE INVENTION

The present invention relates to an antenna assembly and, more specifically, it relates to an antenna assembly for mounted in an electronic device and having an improved mechanical antenna casing.

BACKGROUND OF THE INVENTION

The development of wireless local area network (WLAN) for computers has facilitated the use of electronic devices such as computers for network communication. However, computers are often used in complex radio frequency (RF) environments such as office buildings and the like, where WLANs are usually installed. These environments include physical barriers which give rise to multiple reflections of the signals transmitted or received by the computer. The signals travel over multiple paths, resulting in interference patterns and thus "dead spots". The radio frequency environment is further complicated by movement of persons or equipment within the environment.

So, there is a need to locate the antenna accurately as well as reduce the cost of assembly of antennas. An antenna is typically soldered or screwed into place. This is time consuming and requires special equipment.

Hence, an improved and compact antenna assembly is needed to overcome the above-mentioned deficiencies of current antenna assembly.

SUMMARY OF THE INVENTION

Accordingly, the primary object of the present invention is to provide a mechanical antenna casing of an antenna assembly for accurately fixing an antenna.

An antenna assembly in accordance with the present invention comprises an insulative antenna casing, an antenna body and a flat metal reflector received in the antenna casing. The antenna body includes two metal arms substantially extending opposite to each other and a U-shaped portion connecting the two arms A coaxial cable is soldered to two ends of the U-shaped portion and partly received in the antenna casing. The antenna casing includes a front wall, a back wall, a pair of opposite side walls, a cross wall, a pair of supporting walls each defining an inclined notch in which the antenna is fixedly retained therein. The cross wall is uniformly distanced from the front wall and the back wall and connects with the side walls for separating the antenna body and the metal reflector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
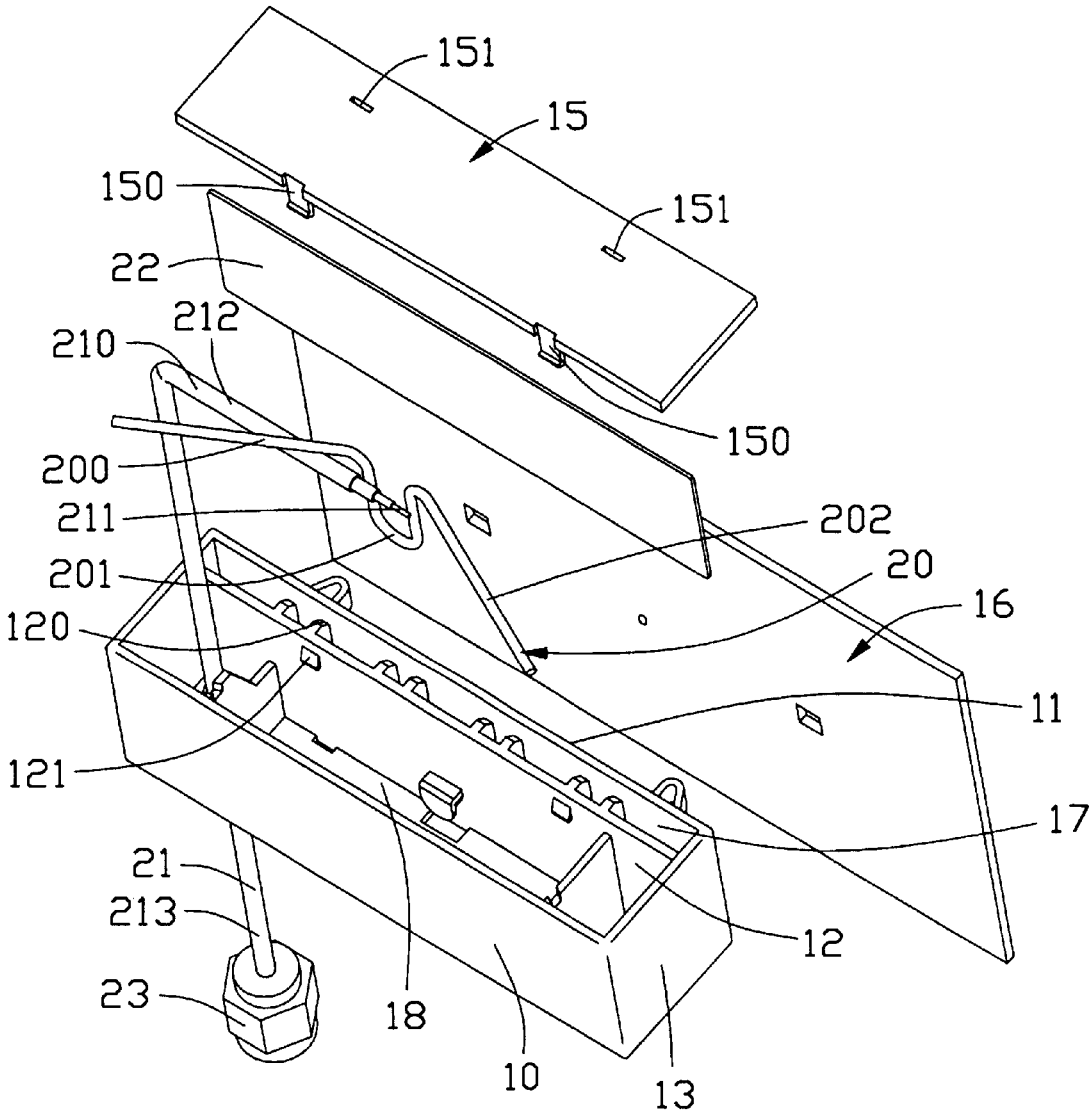
FIG. 1 is an exploded view of an antenna assembly in accordance with the present invention.
Figure 2:
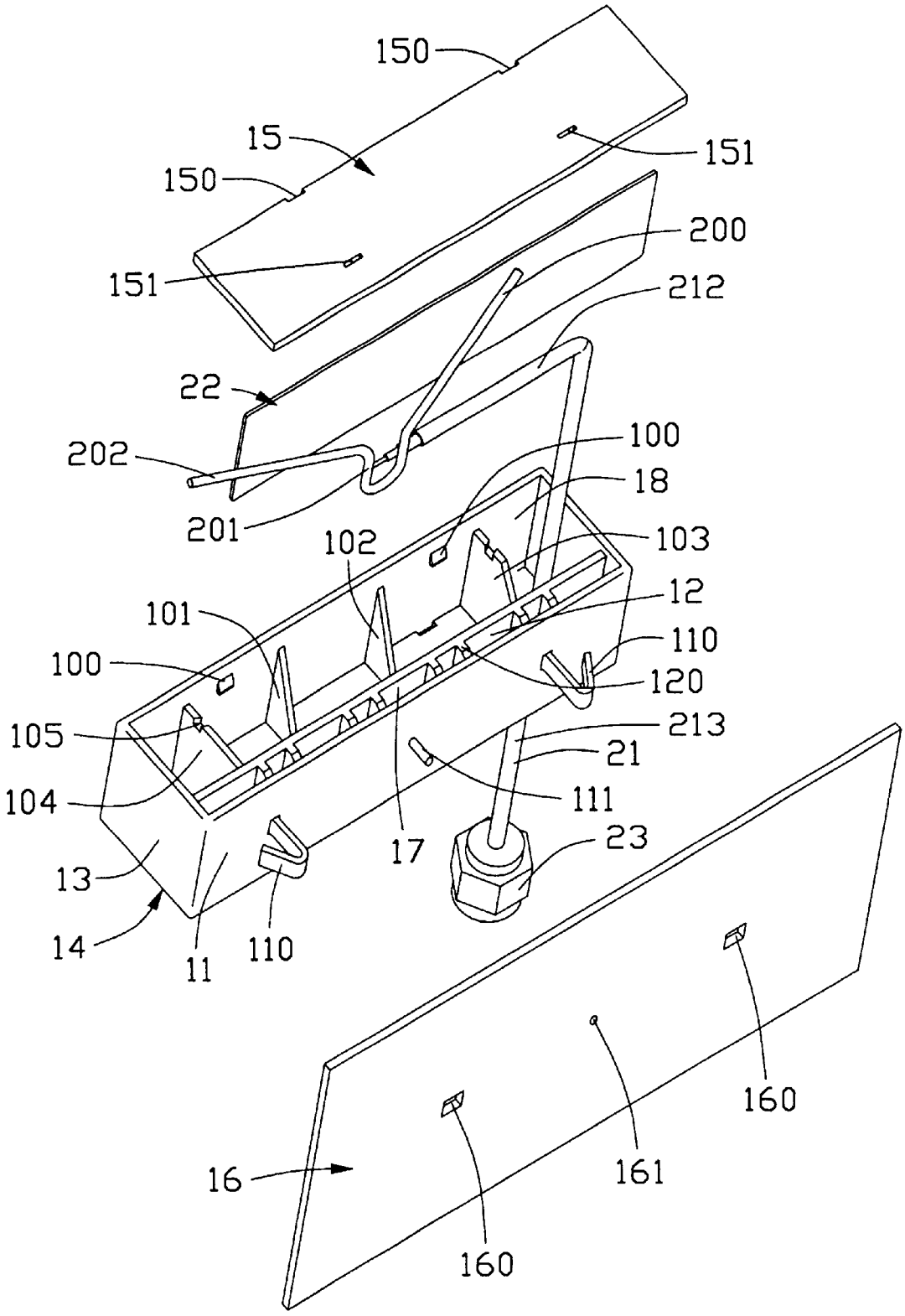
FIG. 2 is another exploded view of the antenna assembly of FIG. 1.
Figure 3:
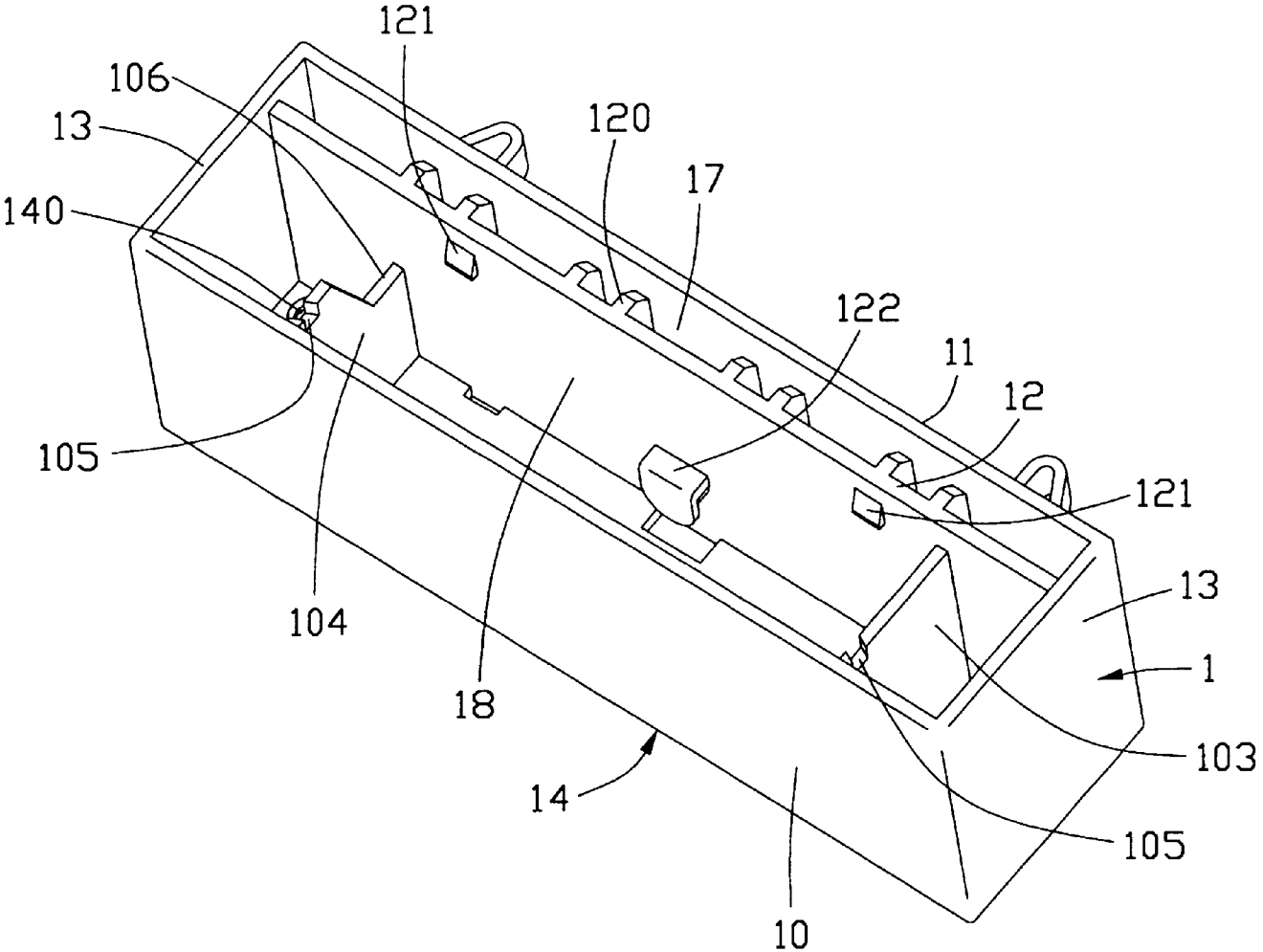
FIG. 3 is a perspective view of an antenna casing of FIG. 1.

Referring to FIGS. 1–3, an antenna assembly in accordance with the present invention comprises a substantially rectangular insulative antenna casing 1, a cover 15, a back panel 16, an antenna body 20, a metal reflector 22, a connector 23 providing an electrical interface to an RF circuitry (not shown) and an inverted-L coaxial cable 21.

The antenna casing 1 defines a cavity (not labeled) and comprises a front wall 10, a back wall 11 opposite to the front wall 10, a pair of side walls 13 opposite to each other, a bottom wall 14 and a cross wall 12. The cross wall 12 is disposed between the front wall 10 and the back wall 11 and, in the embodiment shown, connects the side walls 13. A pair of hooks 110 outwardly extend beyond the back wall 11 and a cylindrical pole 111 extends therebetween beyond the back wall 11. A pair of front hook legs 150 downwardly extend from a front edge of the cover 15, a pair of back hook legs 151 downwardly extend from opposite side of the cover 15. The back hook legs 151 are formed in linewith the corresponding front hook legs 150. A pair of rectangular side holes 160 are defined in line in the back panel 16 for latching the corresponding hooks 110. A circular hole 161 is defined in the back panel 16 between the side holes 160 for locking the corresponding pole 111.

Particularly referring to FIG. 3, the cross wall 12 divides the antenna casing 1 into a back compartment 17 for receiving the reflector 22 and a front compartment 18 for receiving the antenna body 20. A pair of side supporting walls 103, 104 and a pair of mid supporting partitions 101, 102 are inwardly and perpendicularly extending from the front wall 10 and parallel to each other. Each supporting wall 103, 104 defines a notch 105 in an upper end thereof. Each notch 105 is inclined in a uniform angle for receiving the corresponding arms 200, 202 of the antenna body 20 near the front wall 10. The supporting wall 104 further defines an inclined cutout 106 at a back section thereof for supporting the coaxial cable 21. A pair of front wedges 100 are inwardly formed on the front wall 10 with one wedge 100 between the supporting wall 104 and the supporting partition 101 and the other wedge 100 between the supporting wall 103 and the supporting partition 102. The cross wall 12 has a plurality of ribs 120 on one side thereof toward the back compartment 17, a fastener 122 and a pair of back wedges 121 on opposite side thereof toward the front compartment 18. Each rib 120 extends from the cross wall 12 connecting with the bottom wall 14 for relieving insertion resisting force of the metal reflector 22. The fastener 122 is formed at a lower portion of the cross wall 12 and in a mid of the back wedges 121. The bottom wall 14 defines a through hole 140 near the supporting wall 104 for receiving the coaxial cable 21.

The antenna body 20 is made of a conductive metal wire and includes a U-shaped portion 201, a first arm 200 and a second arm 202 respectively extending from opposite extreme ends of the U-shaped portion 201.The first and second arms 200, 202 are of same length and form a same angle with the metal reflector 22. In this embodiment, the inverted-L coaxial cable 21 serves as RF feeder of the antenna body 20 and has a transverse arm 212 connecting the antenna body 20 and a perpendicular arm 213 with the connector 23. The inverted-L coaxial cable 21 has an inner core wire 211 soldered to one end of the U-shaped portion 201 proximate the first arm 200, and an outer shield 210 soldered to the other end of the U-shaped portion 201 proximate the second arm 202.

Figure 4:
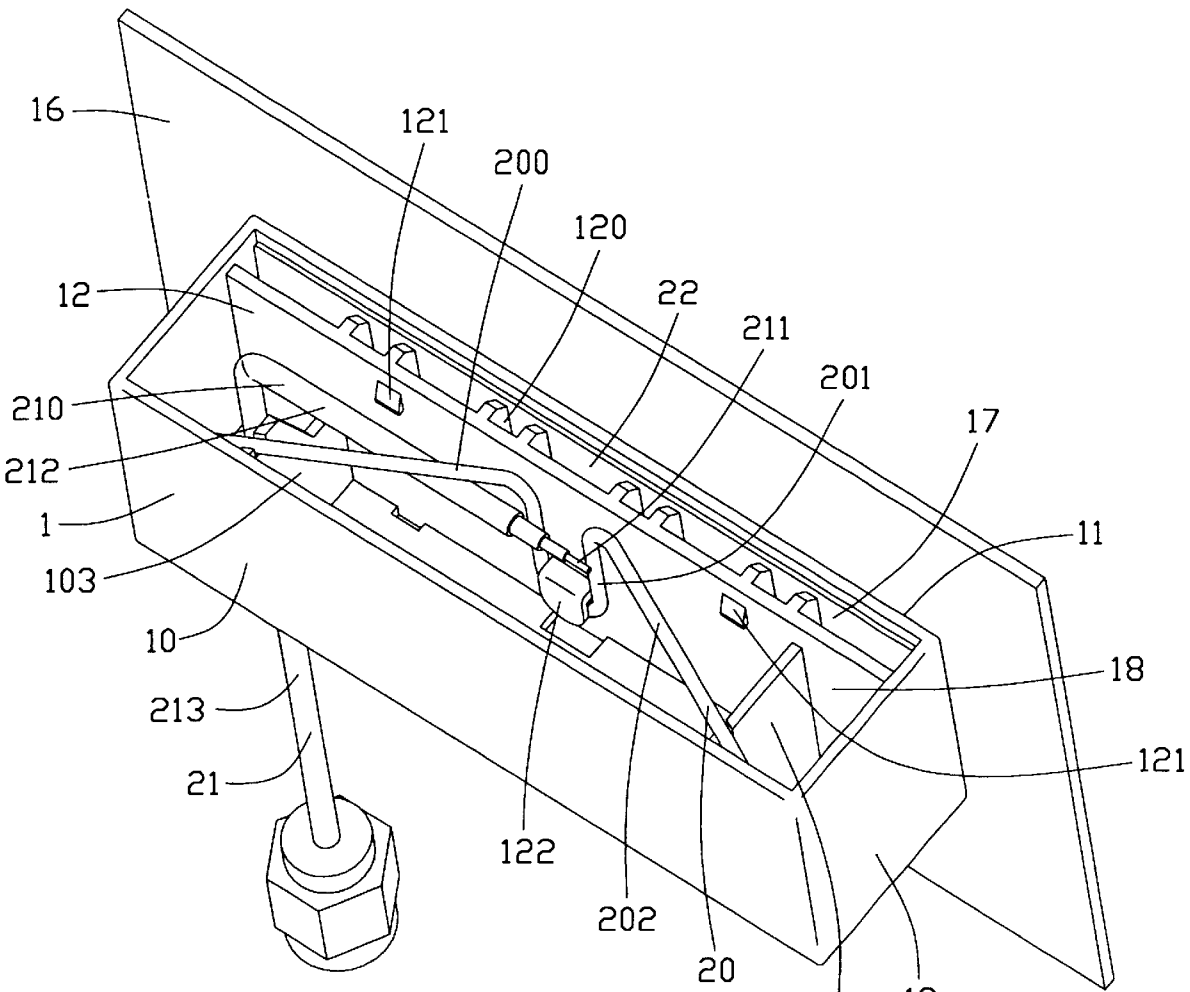
FIG. 4 is an assembly view of the antenna assembly of FIG. 1 wherein a cover is removed for clarity.
Figure 5:
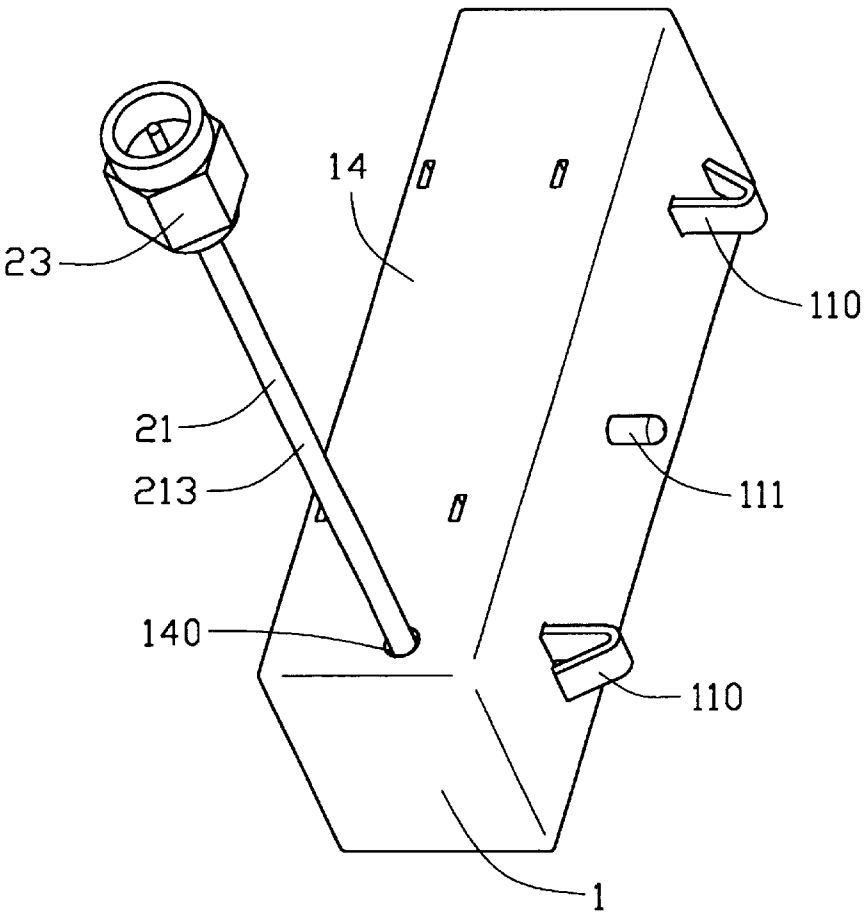
FIG. 5 is an assembly view of the antenna assembly of FIG. 1.

Referring to FIGS. 4 and 5, in assembly, the metal reflector 22 is inserted into the slit (not labeled) of the back compartment 17 of the antenna casing 1. The antenna body 20 is received in the front compartment 18 of the antenna casing 1. The first and second arms 200, 202 of the antenna body 20 are respectively fixedly retained in the corresponding inclined notches 105 of the supporting walls 103, 104, the U-shaped portion 201 is latched in the fastener 122. The perpendicular arm 213 of the coaxial cable 21 goes down through the hole 140 and partly extends from the bottom wall 14 of the antenna casing 1 until the transverse arm 212 of the coaxial cable 21 is fixedly received in the inclined cutout 106. The hooks 110 and the pole 111 of the back wall 11 respectively anchor the side holes 160 and the central hole 161 of the back panel 16. The front and back hook legs 150, 151 are respectively anchored on the corresponding front and back wedges 100, 121.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An antenna assembly, comprising:

an insulative antenna casing having a pair of front wall, a back wall, a pair of opposite side walls, a cross wall connecting with the side walls, a front compartment between the cross wall and the front wall, a back compartment between the cross wall and the back wall and a pair of supporting walls in the front compartment;

an antenna body received in the front compartment, the antenna body including two metal arms substantially extending opposite to each other and respectively fixedly retained to the supporting walls, and a U-shaped portion connecting the two arms;

a metal reflector inserted in the back compartment of the antenna casing; and a cable secured to two ends of the U-shaped portion of the antenna body and partly received in the front compartment of the antenna casing.

2. The antenna assembly in accordance with claim 1, wherein the cross wall forms a fastener at a lower section thereof for receiving the U-shaped portion of the antenna body and a plurality of ribs for relieving insertion resisting force of the metal reflector.

3. The antenna assembly in accordance with claim 1, wherein the cross wall is parallel to the back wall of the antenna casing and uniformly distanced from the front wall and the back wall.

4. The antenna assembly in accordance with claim 1, wherein the first and the second arms form a same angle with respect to the cross wall and said supporting walls each define a notch for locating the first and the second arms of the antenna body.

5. The antenna assembly in accordance with claim 4, wherein the notches are inclined in a uniform angle with respect to the supporting walls.

6. The antenna assembly in accordance with claim 1, wherein the antenna casing comprises a cover having two pairs of hook legs, and each of the cross wall and the front wall of the housing forms a pair of wedges for latching the hook legs.

7. The antenna assembly in accordance with claim 1, wherein the antenna casing has a bottom wall defining a through hole and one of the two supporting walls defines a cutout, and wherein the cable has a perpendicular arm across the through hole and a transverse arm received in the cutout.

8. An antenna assembly arrangement adapted for locating an antenna and an associated reflector, the arrangement comprising:

an insulative casing having a pair of opposite side walls, a front wall, a back wall, a cross wall disposed between the front wall and the back wall, a front compartment between the cross wall and the front wall for receiving the antenna, a back compartment between the cross wall and the back wall for receiving the associated reflector, and a pair of supporting walls inwardly and perpendicularly extending from the front wall for retaining the antenna; and a cover for fixedly covering the insulative casing.

9. The antenna assembly arrangement in accordance with claim 8, wherein the front wall has a pair of first wedges inwardly formed thereon and the cross wall has a pair of second wedges thereon toward the front wall, and wherein the cover has a pair of first hook legs and a pair of second hook legs extending downwardly for latching with the first and second wedges.

10. The antenna assembly arrangement in accordance with claim 8, wherein the back wall has a pair of hooks and a pole thereon.

11. The antenna assembly arrangement in accordance with claim 8, wherein the cross wall forms a fastener at a lower section thereof for receiving the antenna and a plurality of ribs for relieving insertion resisting force of the reflector.

12. The antenna assembly arrangement in accordance with claim 8, wherein the supporting walls each define a notch for retaining the antenna.

13. An antenna assembly for mounting to a panel, comprising:

a casing defining a cavity therein;

an antenna body retainably received in said cavity, said antenna body including a pair of obliquely extending metal arms with a bight connected therebetween, said antenna body retained in position in the cavity; and a metal reflector extending along a longitudinal direction of the casing along which said pair of metal arms generally extend, said metal reflector being spaced from said antenna body with a predetermined distance and retained in position in the cavity.

14. The assembly in accordance with claim 13, wherein a cable extends through and into the casing and connects to the antenna body, and a distal end of said cable outside the casing is connected to an electronic component.

15. The assembly in accordance with claim 13, wherein said antenna body is retained by either a supporting wall or a cross wall formed in the cavity of the casing.

16. The assembly in accordance with claim 13, wherein said metal reflector is retained in a retaining slit.

17. The assembly in accordance with claim 13, wherein said antenna body is retained in retaining slots.

18. The assembly in accordance with claim 13, wherein said metal reflector and said antenna body is separated from each other by a cross wall extending along the longitudinal direction of said casing.

19. The assembly in accordance with claim 13, wherein a cover is latchably attached to said casing perpendicular to said metal reflector.

* * * * *